US006486624B2

(12) United States Patent
Kimiya et al.

(10) Patent No.: US 6,486,624 B2
(45) Date of Patent: Nov. 26, 2002

(54) CATHODE RAY TUBE APPARATUS

(75) Inventors: Junichi Kimiya, Kumagaya (JP); Shunji Ookubo, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/910,736

(22) Filed: Jul. 24, 2001

(65) Prior Publication Data

US 2002/0047657 A1 Apr. 25, 2002

(30) Foreign Application Priority Data

Jul. 26, 2000 (JP) ..... 2000-225734

(51) Int. Cl.[7] ..... H01J 29/46
(52) U.S. Cl. ..... 315/382; 313/414; 315/3
(58) Field of Search ..... 315/14–16, 382, 315/414, 3; 313/412, 413, 414

(56) References Cited

U.S. PATENT DOCUMENTS 5,610,475 A * 3/1997 Hsing-Yao ..... 313/412
5,994,826 A * 11/1999 Ueno et al. ..... 313/412
6,016,030 A * 1/2000 Amano et al. ..... 313/414
6,225,766 B1 * 5/2001 Ono et al. ..... 313/414
6,225,788 B1 * 5/2001 Kouzu et al. ..... 320/150

FOREIGN PATENT DOCUMENTS

JP 3-93135 4/1991

* cited by examiner

*Primary Examiner*—Don Wong
*Assistant Examiner*—Ephrem Alemu
(74) *Attorney, Agent, or Firm*—Oblon, Spivak, McClelland, Maier & Neustadt, P.C.

(57) ABSTRACT

An electron gun structure includes a first non-axial-symmetrical lens portion which is arranged in the vicinity of an electron beam formation portion, and a second non-axial-symmetrical lens portion formed to a main lens portion, the first non-axial symmetrical lens portion has a lens action in the vertical direction that a focusing action relative to the electron beams becomes stronger as a quantity of deflection of the electron beams increases, and a lens action in the horizontal direction which substantially rarely acts on the electron beams, and a comprehensive lens system of the second non-axial-symmetrical lens portion and the main lens portion has a lens action in the vertical direction that a divergence action relative to the electron beams becomes stronger as a quantity of deflection of the electron beams increases, and a lens action in the horizontal direction which substantially rarely acts on the electron beams.

9 Claims, 5 Drawing Sheets

CATHODE RAY TUBE APPARATUS

CROSS-REFERENCE TO RELATED APPLICATIONS

This application is based upon and claims the benefit of priority from the prior Japanese Patent Application No. 2000-225734, filed Jul. 26, 2000, the entire contents of which are incorporated herein by reference.

BACKGROUND OF THE INVENTION

1. Field of the Invention

The present invention relates to a cathode ray tube apparatus, and more particularly to a cathode ray tube having an electron gun structure for performing dynamic astigmatism-correction mounted thereon.

2. Description of the Related Art

In general, a color cathode ray tube apparatus is provided with an inline type electron gun structure for emitting triple electron beams, and a deflecting yoke for generating a deflection magnetic field for scanning on a phosphor screen in a horizontal direction and a vertical direction by deflecting the electron beams emitted from the electron gun structure. This deflecting yoke forms a non-uniform magnetic field by a pin cushion type horizontal deflection magnetic field and a barrel type vertical deflection magnetic field.

The electron beams having passed through such a non-uniform magnetic field are affected by deflection aberration, i.e., astigmatism included in the deflection magnetic field. Therefore, a beam spot of the electron beams which have reached a periphery part of the phosphor screen is over-focused in the vertical direction by deflection aberration, which results in blur in the vertical direction and lateral collapse wide in the horizontal direction. The deflection aberration which affects the electron beams becomes larger as a dimension of the tube is increased and a deflection angle becomes wider. Such distortion of the beam spot considerably deteriorates the resolution of the periphery part of the phosphor screen.

As means for solving deterioration of the resolution caused due to the deflection aberration, there is such an electron gun structure as disclosed in Jpn. Pat. Appln. KOKAI Publication No. 61-99249. This electron gun structure is provided with first to fifth grids and forms an electron beam generation portion, a non-axial-symmetrical lens, and a final main focus lens along a traveling direction of the electron beams. The non-axial-symmetrical lens is formed by providing three non-axial-symmetrical electron beam passage holes on each of opposed surfaces of electrodes adjacent to each other.

This electron gun structure reduces the influence of the deflection aberration of the deflection magnetic field given to the electron beams which are deflected around the phosphor screen and corrects the distortion of the beam spot by changing lens intensities of the non-axial-symmetrical lens and the final main lens in synchronization with a change in the deflection magnetic field.

In such an electron gun structure, however, when the electron beams are defected around the phosphor screen, the influence of the deflection aberration of the deflection magnetic field is extremely large. Further, even if the blur of the beam spot can be eliminated, the lateral collapse can not be sufficiently corrected.

Furthermore, as another means for solving deterioration of the resolution caused due to the deflection aberration, there is proposed such a dynamic focusing type electron gun structure as disclosed in Jpn. Pat. Appln. KOKAI Publication No. 64-38497.

This electron gun structure constitutes a final main focus lens by a dynamic focus electrode to which a dynamic focus voltage is applied, an anode electrode to which an anode voltage is applied, and an auxiliary electrode arranged between these electrodes. To the auxiliary electrode is supplied a voltage obtained by subjecting the anode voltage to resistance division by using a resistor arranged in the vicinity of the electron gun structure.

As a result, each non-axial-symmetrical lens is formed between the dynamic focus electrode and the auxiliary electrode and between the auxiliary electrode and the anode electrode. When the dynamic focus voltage is applied to the dynamic focus electrode according to deflect the electron beams in the periphery part of the phosphor screen, the final main focus lens including the non-axial-symmetrical lens generates the lens action for divergence only in the vertical direction without producing the lens action in the horizontal direction.

This electron gun structure corrects the distortion of the electron beam spot in the periphery part of the phosphor screen by such a lens action.

In such an electron gun structure, however, an alternating component of the dynamic focus voltage is superposed on the applied voltage of the auxiliary electrode by the electrostatic capacity between the electrodes constituting the final main focus lens by applying the dynamic focus voltage to the dynamic focus electrode. As a result, the non-axial-symmetrical lens formed between the dynamic focus electrode and the auxiliary electrode lacks the lens action, and an undesired lens action is generated to the non-axial-symmetrical lens formed between the auxiliary electrode and the anode electrode.

Therefore, the distortion of the beam spot can not be sufficiently corrected in the periphery part of the phosphor screen, and the excellent focusing characteristic can be hardly obtained in the entire phosphor screen area.

In order to obtain the excellent focusing characteristic in the entire phosphor screen area, the distortion of the beam spot must be corrected in the periphery area of the phosphor screen. Moreover, it is necessary to reduce a superposition ratio of the alternating component of the dynamic focus voltage to the auxiliary electrode and form the sufficient lens action to the lens for compensating the influence of the deflection aberration to the electron beams.

BRIEF SUMMARY OF THE INVENTION

In view of the above-described problems, it is an object of the present invention to provide a cathode ray tube apparatus capable of forming a beam spot having an excellent shape across an entire phosphor screen area.

According to the present invention, there is provided a cathode ray tube apparatus comprising:

an electron gun structure having an electron beam formation portion for forming electron beams and a main lens portion for focusing the electron beams on a phosphor screen; and a deflection yoke for generating a deflection magnetic field for scanning in a horizontal direction and a vertical direction on the phosphor screen by deflecting the electron beams emitted from the electron gun structure, wherein the electron gun structure includes a first non-axial-symmetrical lens portion whose lens action changes in accordance with a quantity of deflection of the electron beams and which is arranged in the vicinity of the electron beam formation portion and a second non-axial-symmetrical lens portion whose lens action changes in accordance with a quantity of deflection of the electron beam and which is formed to the main lens portion;

the first non-axial-symmetrical lens portion has a lens action in the vertical direction by which a focusing action relative to the electron beams is strengthened as a quantity of deflection of the electron beams increases and a lens action in the horizontal direction which substantially rarely acts on the electron beams as compared with the lens action in the vertical direction; and a comprehensive lens system of the second non-axial-symmetrical lens portion and the main lens portion has a lens action in the vertical direction by which a divergence action relative to the electron beams is strengthened as a quantity of deflection of the electron beams increases and a lens action in the horizontal direction which substantially rarely acts on the electron beams relatively.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

An embodiment of a cathode ray tube apparatus according to the present invention will now be described with reference to the accompanying drawings.

Figure 1:
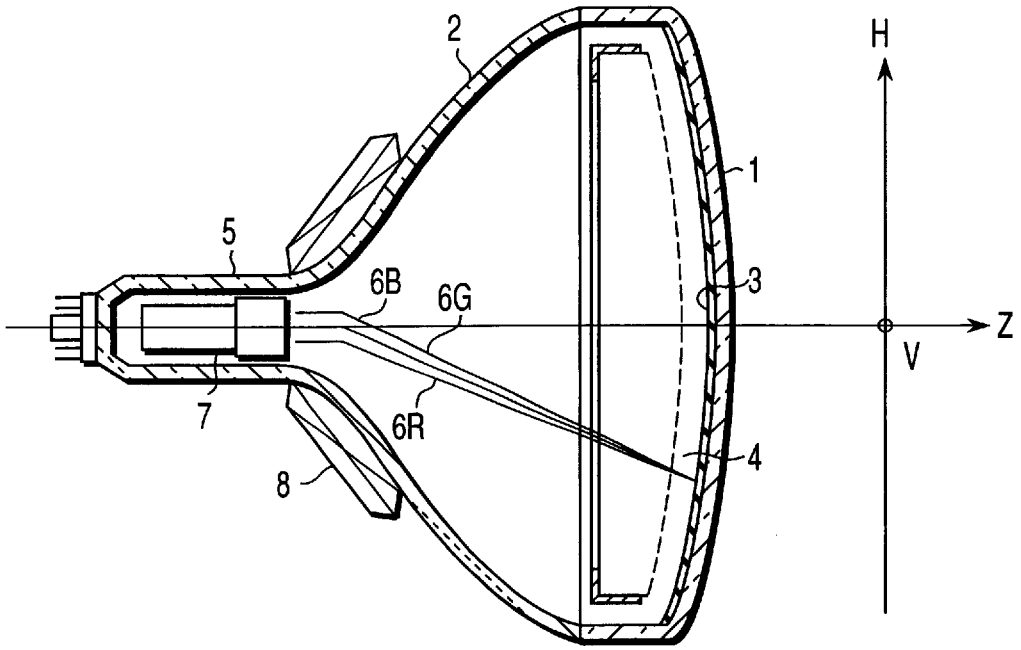
FIG. 1 is a horizontal cross-sectional view schematically showing a structure of a cathode ray tube apparatus according to the present invention.

As shown in FIG. 1, a cathode ray tube apparatus according to the present invention has an envelope consisting of a panel 1 and a funnel 2 integrally joined to the panel 1. The panel 1 is provided with a phosphor screen 3 (target) consisting of stripe type or dot type three-color phosphor layers which emit light rays of blue, green and red, respectively, the phosphor screen 3 being arranged on the inner surface of the panel 1. A shadow mask 4 is attached so as to be opposed to the phosphor screen 3 and has multiple apertures on the inner side thereof.

An inline type electron gun structure 7 is provided inside a neck 5. The electron gun structure 7 emits in a tube axis direction Z three electron beams 6B, 6G and 6R arranged in a line in the horizontal direction H, the three electron beams being a center beam 6G passing on the same horizontal plane and a pair of side beams 6B and 6R on the both sides of the center beam 6G. The inline type electron gun structure 7 causes self-convergence of the three electron beams in the center of the phosphor screen 3 by decentering the positions of side beam passage holes of a low-voltage side grid and a high-voltage side grid constituting a main lens portion.

A deflection yoke 8 is attached on the outside of the funnel 2. This deflection yoke 8 generates a non-uniform deflection magnetic field for deflecting the three electron beams 6B, 6G and 6R emitted from the electron gun structure 7 in the horizontal direction H and the vertical direction V. This non-uniform deflection magnetic field is formed by a pin cushion type horizontal deflection magnetic field and a barrel type vertical deflection magnetic field.

The three electron beams 6B, 6G and 6R emitted from the electron gun structure 7 are focused onto the corresponding phosphor layers on the phosphor screen 3 while being subjected to self-convergence toward the phosphor screen 3. The three electron beams 6B, 6G and 6R are then scanned in the horizontal direction H and the vertical direction V of the phosphor screen 3 by a non-uniform deflection magnetic field. As a result, a color image is displayed.

Figure 2:
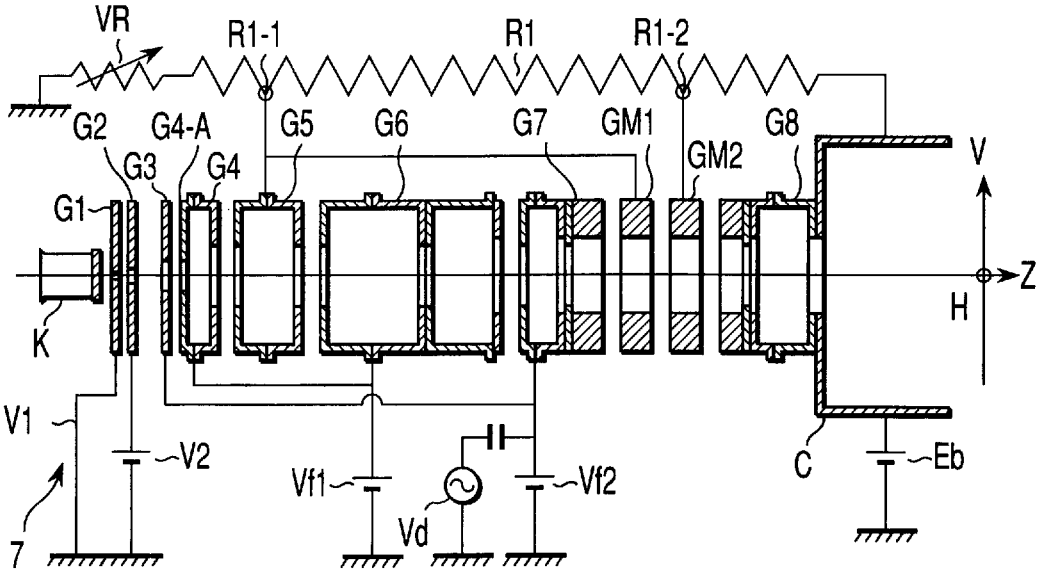
FIG. 2 is a vertical cross-sectional view schematically showing an embodiment of an electron gun structure applied to the cathode ray tube apparatus illustrated in FIG. 1.

As shown in FIG. 2, the electron gun structure 7 applied to this cathode ray tube apparatus includes: a cathode K; a first grid G1; a second grid G2; a third grid G3 (first dynamic focus electrode); a fourth grid G4 (first focus electrode); a fifth grid G5 (auxiliary electrode); a sixth grid G6 (second focus electrode); a seventh grid G7 (second dynamic focus electrode); an eighth grid GM1 (intermediate electrode); a ninth grid GM2; a tenth grid G8 (anode electrode); and a convergence cup C. The ten grids and the convergence cup C are arranged along the traveling direction of the electron beams in the mentioned order, and supported and fixed by insulating supports (not shown).

The first grid G1 is grounded (or has a minus potential V1 applied thereto). To the second grid G2 is applied an accelerating voltage V2 having a low potential. This accelerating voltage V2 is 500 V to 1 KV.

The fourth grid G4 and the sixth grid G6 are connected to each other in the tube and a first focus voltage Vf1 having a constant intermediate potential is supplied to these grids from the outside of the cathode ray tube. The first focus voltage Vf1 is a voltage corresponding to approximately 22% to 32% of a later-described anode voltage Eb, and is approximately 6 to 10 KV for example.

The third grid G3 and the seventh grid G7 are connected to each other in the tube. Additionally, to the third grid G3 and the seventh grid G7 is supplied from the outside of the cathode ray tube a dynamic focus voltage (Vf2+Vd) in which an alternating voltage component Vd synchronized with a deflection magnetic field generated by the deflection yoke is superposed on a second focus voltage Vf2 which is substantially equal to the first focus voltage Vf1. As similar to the first focus voltage Vf1, the second focus voltage Vf2 is a voltage corresponding to approximately 22% to 32% of the anode voltage Eb, and is approximately 6 to 10 KV for example. Further, the alternating voltage Vd fluctuates from 0V to 300 to 1500V in synchronization with the deflection magnetic field.

The tenth grid G8 and the convergence cup C are connected to each other, and the anode voltage Eb is supplied to them from the outside of the cathode ray tube. This anode voltage Eb is approximately 25 to 35 KV.

A resistor R1 is provided in the vicinity of the electron gun structure 7 as shown in FIG. 2. One end of the resistor R1 is connected to the tenth grid G8, and the other end of the same is grounded through a variable resistor VR provided outside the tube. The resistor R1 has voltage supply terminals R1-1 and R1-2 in the middle thereof for supplying the voltage to the grids of the electron gun structure 7.

The fifth grid G5 and the eighth grid GM1 are connected to each other in the tube, and also connected to the voltage supply terminal R1-1 on the resistor R1 in the vicinity of the fifth grid G5. To the fifth grid G5 and the eighth grid GM1 is supplied a voltage obtained by performing resistance division to the anode voltage Eb, e.g., a voltage which is approximately 35 to 45% of the anode voltage Eb through the voltage supply terminal R1-1.

The ninth grid GM2 is connected to the voltage supply terminal R1-2 on the resistor R1 in the vicinity thereof. To the ninth grid GM2 is supplied through the voltage supply terminal R1-2 a voltage obtained by performing resistance division to the anode voltage Eb, e.g., a voltage which is approximately 50 to 70% of the anode voltage Eb.

The first grid G1 is a thin plate-like electrode and has three circular electron beam passage holes each of which has a small diameter which are formed by boring the plate surface. The second grid G2 is a thin plate-like electrode and has three circular electron beam passage holes each of which has a diameter slightly larger than the bore diameter formed to the first grid G1.

Figure 3A:
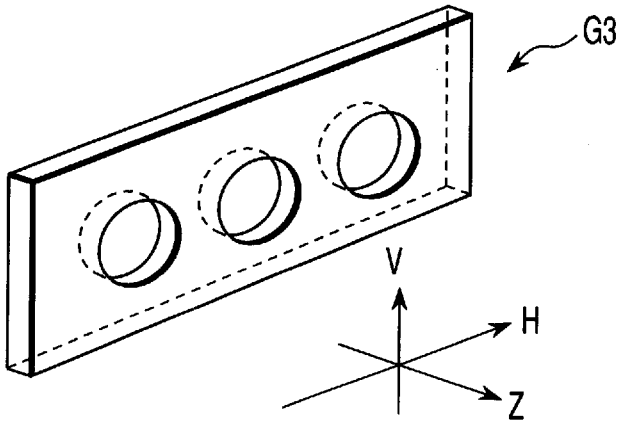
FIG. 3A is a perspective view schematically showing a structure of a third grid in the electron gun structure depicted in FIG. 2.

As shown in FIG. 3A, the third grid G3 is a plate-like electrode and has three circular electron beam passage holes each of which has a diameter slightly larger than the bore diameter formed to the second grid G2.

Figure 3B:
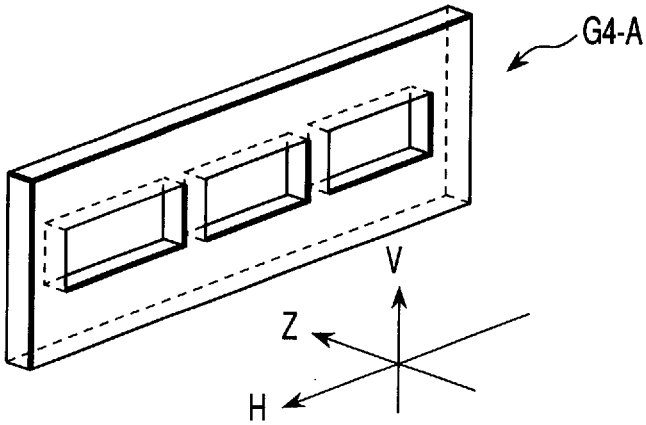
FIG. 3B is a perspective view schematically showing a shape of electron beam passage holes formed on a surface of a fourth grid which is opposed to the third grid in the electron gun structure illustrated in FIG. 2.

The fourth grid G4 is formed by opposing opening ends of two cup-like electrodes elongated in the tube axis direction Z to each other. The end surface of the cut-like electrode opposed to the third grid G3 has three electron beam passage holes as shown in FIG. 3B. Each of these electron beam passage holes has a shape which is long sideways that the diameter thereof in the vertical direction is substantially equivalent to that of the electron beam passage holes of the third grid G3 and the diameter thereof in the horizontal direction is larger than that of the electron beam passage holes of the third grid G3.

The fifth grid G5 is formed by opposing opening ends of the two cup-like electrodes which are long in the tube axis direction Z to each other. The end surface of the cup-like electrode opposed to the fourth grid G4 has three circular electron beam passage holes each of which has a large diameter. Furthermore, the end surface of the cup-like electrode opposed to the sixth grid G6 has three circular electron beam passage holes each of which has a large diameter.

The sixth grid G6 is constituted by three cup-like electrodes which are long in the tube axis direction Z and one plate-like electrode. Two cup-like electrodes on the fifth grid G5 side have their opening ends opposed to each other; two cup-like electrodes on the seventh grid G7 side have their opening ends opposed to each other; and a cup-like electrode on the seventh grid G7 side has its opening end opposed to a thin plate-like electrode. The end surface of each of three cup-like electrodes has three electron beam passage holes each having a large diameter. The plate-like electrode opposed to the seventh grid G7 has three vertically elongated or circular electron beam passage holes each having a vertically long shape elongated in the vertical direction V or a circular shape.

The seventh grid G7 is constituted by two cup-like electrodes and two plate-like electrodes which are short in the tube axis direction Z. Two cup-like electrodes on the sixth grid G6 side have their opening ends opposed to each other, and a cup-like electrode on the eighth grid GM1 side has an opening end opposed to a thin plate-like electrode. Furthermore, this thin-plate like electrode is opposed to a thick plate-like electrode.

The end surface of the cup-like electrode opposed to the sixth grid G6 has three electron beam passage holes which are long sideways in the horizontal direction H. The end surface of the cup-like electrode on the eighth grid GM1 side has three circular electron beam passage holes each of which has a large diameter. The plate surface of the thin plate-like electrode has three electron beam passage holes with a large diameter which are long sideways in the horizontal direction H. The plate surface of the thick plate-like electrode opposed to the seventh grid GM1 has three circular electron beam passage holes with a large diameter.

The eighth grid GM1 and the ninth grid GM2 are constituted by thick plate-like electrodes. The plate surface of each of these plate-like electrodes has three circular electron beam passage holes with a large diameter.

The tenth grid G8 is constituted by two plate-like electrodes and two cup-like electrodes. The thick plate-like electrode opposed to the ninth grid GM2 is opposed to the thick plate-like electrode, and the thin plate-like electrode is opposed to the end surface of the cup-like electrode.

Moreover, the two cup-like electrodes have their opening ends opposed to each other.

The thick plate-like electrode opposed to the ninth grid GM2 has three circular electron beam passage holes with a large diameter. The thin plate-like electrode has three electron beam passage holes with a large diameter which are long sideways in the horizontal direction H. The end surface of each of the two cup-like electrodes has three circular electron beam passage holes each having a large diameter.

The end surface of the convergence cup C is opposed to the end surface of the cup-like electrode of the tenth grid G8. Then, end surface of the convergence cup C has three circular electron beam passage holes each having a large diameter.

In the electron gun structure 7 having such a structure as described above, a cathode K, the first grid G1 and the second grid G2 form an electron beam formation portion. The second grid G2 and the third grid G3 form a pre-focus lens PL for preliminary focusing the electron beams generated from the electron beam formation portion.

Between the third grid G3 and the fourth grid G4 is formed a first quadrupole lens (first non-axial-symmetrical lens) QL1 whose lens intensity changes by a dynamic focus voltage (Vf2+Vd) which fluctuates in accordance with a quantity of deflection of the electron beams.

The fourth grid G4, the fifth grid G5 and the sixth grid G6 form a sub lens for further preliminarily focusing the electron beams which have been preliminarily focused.

Between the sixth grid G6 and the seventh grid G7 is formed a second quadrupole lens (second non-axial-symmetrical lens) QL2 whose lens intensity varies by the dynamic focus voltage (Vf2+Vd) which fluctuates in accordance with a quantity of deflection of the electron beams.

The seventh grid G7, the eighth grid GM1, the ninth grid GM2 and the tenth grid G8 form a main lens ML for finally focusing the preliminarily focused electron beams onto the phosphor screen.

Between the seventh grid G7 and the eighth grid GM1 forming the main lens is formed a non-symmetrical lens whose lens intensity changes by the dynamic focus voltage (Vf2+Vd) which fluctuates in accordance with a quantity of deflection of the electron beams and whose lens intensity differs depending on the horizontal direction H and the vertical direction V. This non-symmetrical lens relatively has the divergence action in the horizontal direction and the focusing action in the vertical direction.

Moreover, between the ninth grid GM2 and the tenth grid G8 forming the main lens is formed a non-symmetrical lens whose lens intensity differs depending on the horizontal direction H and the vertical direction V. This non-symmetrical lens relatively has the divergence action in the vertical direction V and the focusing direction in the horizontal direction H.

The electron gun structure having the structure mentioned above has the following characteristics.

(1) The third grid G3 (first dynamic focus electrode), the fourth grid G4 (first focus electrode) and the fifth grid G5 (auxiliary electrode) are arranged in the vicinity of the electron beam generation portion, and the first quadrupole lens (first non-axial-symmetrical lens) is formed between the third grid G3 and the fourth grid G4.

(2) The fifth grid G5 is arranged between the fourth grid G4 and the sixth grid G6 (second focus electrode), and the fifth grid G5 is electrically connected to the eighth grid GM1 (intermediate electrode) which is adjacent to the seventh grid G7 (second dynamic focus electrode). The composite lens action of (1) and (2) can be means for solving the problems.

The effects and advantages of (1) will be first described.

The third grid G3 has a substantially circular electron beam passage hole. The fourth grid G4 has an electron beam passage hole which is long sideways on a surface thereof opposed to the third grid G3. When there is no deflection for focusing the electron beams onto the center of the phosphor screen, the dynamic focus voltage (Vf2+Vd) applied to the third grid G3 is lower than the first focus voltage Vf1. Further, at the time of deflection for deflecting the electron beams toward the periphery part of the phosphor screen, the dynamic focus voltage (Vf2+Vd) applied to the third grid G3 is increased as a quantity of deflection of the electron beams becomes large, and a difference in potential between the third grid G3 and the fourth grid G4 is reduced. Alternatively, at the time of no deflection, the dynamic focus voltage (Vf2+Vd) applied to the third grid G3 is set to be substantially equivalent to or slightly lower than the first focus voltage Vf1 and increased as a quantity of deflection of the electron beams becomes large.

As a result, when the lens intensity of each of the pre-focus lens formed between the second grid G2 and the third grid G3 and the first quadrupole lens (first non-axial-symmetrical lens) formed between the third grid G3 and the fourth grid G4 fluctuates in synchronized with the deflection magnetic field, the lens action in the pre-focus lens has the focusing action in both the horizontal direction and the vertical direction. Furthermore, the lens action in the first quadrupole lens has the divergence action in the horizontal direction and the focusing action in the vertical direction as a quantity of deflection of the electron beams increases. The comprehensive lens of these lenses is a non-axial-symmetrical lens having a constant lens action demonstrating a weak divergence action or substantially no action in the horizontal direction and a strong focusing action in the vertical direction as a quantity of deflection of the electron beams increases. As to the lens action, assuming that the lens action in the vertical direction is "1", the lens action in the horizontal direction becomes not more than "¼".

Figure 4A:
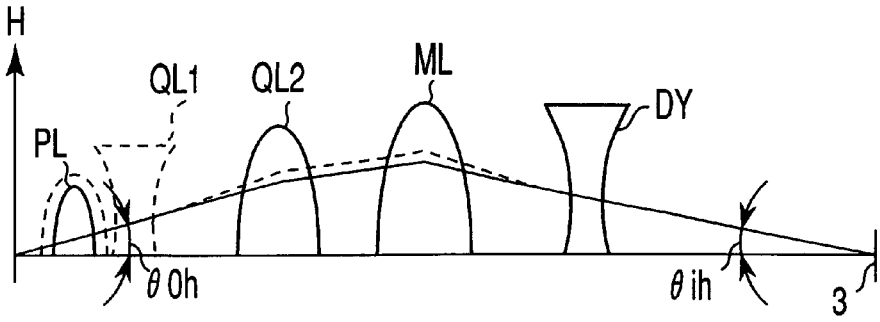
FIG. 4A shows an optical model for illustrating a horizontal lens action which acts on electron beams in the electron gun structure depicted in FIG. 2.
Figure 4B:
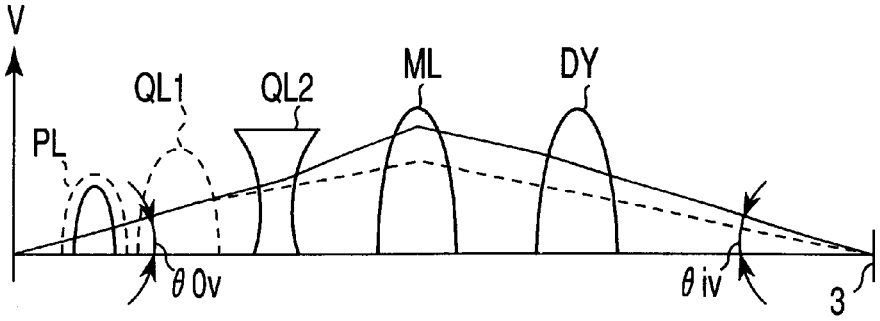
FIG. 4B shows an optical model for illustrating a vertical lens action which acts on electron beams in the electron gun structure illustrated in FIG. 2.

Description will now be given as to the lens action acting on the electron beams during deflection in accordance with presence/absence of the first non-axial-symmetrical lens QL1. As shown in FIGS. 4A and 4B, the electronic lens action in this electron gun structure is represented by an optical model consisting of a pre-focus lens PL, the first non-axial-symmetrical lens QL1, a second non-axial-symmetrical lens QL2, a main lens ML and a deflection aberration component DY.

The dimension of a beam spot on the phosphor screen 3 depends on the magnification M. The magnification M is expressed by a divergence angle θo/a incidence angle θi. That is, the dimension of a beam spot is in inverse proportion to the incidence angle θi. Here, it is assumed that the magnification in the horizontal direction is Mh and the magnification in the vertical direction is Mv. Mh and Mv can be expressed as follows, respectively:

Mh (horizontal magnification) S θoh (horizontal divergence angle)/θih (horizontal incidence angle)

Mv (vertical magnification) S θov (vertical divergence angle)/θiv (vertical incidence angle)

In case of θoh=θov, when there is no first non-axial-symmetrical lens QL1, a large difference is produced in the incidence angle upon the phosphor screen 3 between the horizontal direction and the vertical direction as indicated by solid lines in FIGS. 4A and 4B. When the electron beams are deflected around the screen, $\theta ih<\theta iv$ is attained. That is, the diameter in the horizontal direction>the diameter in the vertical direction is achieved, and the distortion which is long sideways is generated in the beam spot.

Figure 4C:
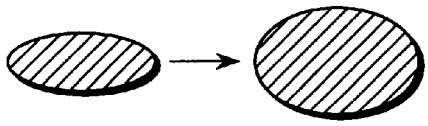
FIG. 4C is a view for illustrating alleviation of the oval distortion of a beam spot in a phosphor screen periphery part.

When there is the first non-axial-symmetrical lens QL1, $\theta oh \approx \theta ov$ is maintained as indicated by broken lines in FIGS. 4A and 4B. Since the comprehensive lens formed by the second grid G2, the third grid G3 and the fourth grid G4 acts as a non-axial-symmetrical lens having the focusing action in the vertical direction relatively stronger than that in the horizontal direction, a difference in the incidence angle upon the phosphor screen between the horizontal direction and the vertical direction can be reduced. That is, when there is no first non-axial-symmetrical lens QL1, the non-axial-symmetrical lens QL1 acts on the electron beams in a direction that the relationship of $\theta ih<\theta iv$ can be changed to $\theta ih>\theta iv$ and consequently the non-axial-symmetrical lens QL1 can change $\theta iv$ so as to be substantially equal to $\theta ih$. That is, the diameter of the beam spot in the vertical direction can be substantially equal to that in the horizontal direction. Therefore, the oval distortion of the beam spot of the electron beams focused around the phosphor screen 3 is alleviated and the beam spot becomes substantially circular, as shown in FIG. 4C.

The effects and advantages of (2) will now be described.

Figure 5A:
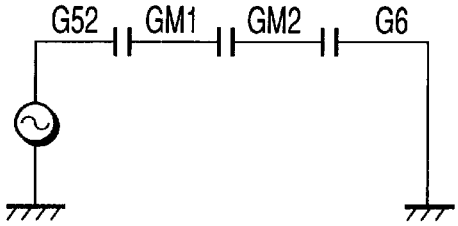
FIG. 5A is a view for illustrating an equivalent circuit of a main lens in a conventional electron gun structure.
Figure 5B:
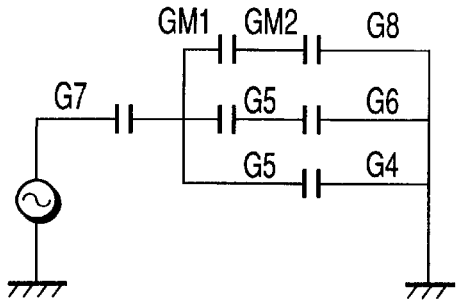
FIG. 5B is a view for illustrating the equivalent circuit of the main lens in the electron gun structure.

With a structure such as described in (2), it is possible to reduce a superposition ratio of the alternating voltage component Vd of the dynamic focus voltage (Vf2+Vd) relative to the eighth grid GM1 (intermediate electrode) forming the main lens. That is, the equivalence circuit of the main lens of the electron gun structure having the structure disclosed in Jpn. Pat. Appln. KOKAI Publication No. 64-38947 is compared with that of the electron gun structure according to this embodiment. As shown in FIG. 5A, the superposition ratio of the dynamic focus voltage to GM1 and GM2 in the prior art electron gun structure was GM2/GM1=66%/33%. On the other hand, as shown in FIG. 5B, the superposition ratio of the dynamic focus voltage to GM1 and GM2 in the electron gun structure according to this embodiment can be GM2/GM1=26%/13%.

According to the cathode ray tube apparatus having the structure in which the main lens includes the intermediate electrode to which a voltage divided by resistance division by the resistor R1 is applied, provision of the structure of (2) mentioned above can reduce the superposition ratio of the dynamic focus voltage to the intermediate electrode superposed through the electrostatic capacity between the electrodes arranged in front of and at the rear of the intermediate electrode. Consequently, the oval distortion of the beam spot in the periphery part of the phosphor screen can be improved.

This phenomenon will now be described in detail hereinafter. It is to be noted that a number of the intermediate electrode arranged to the main lens is one for the sake of brief explanation.

Figure 6:
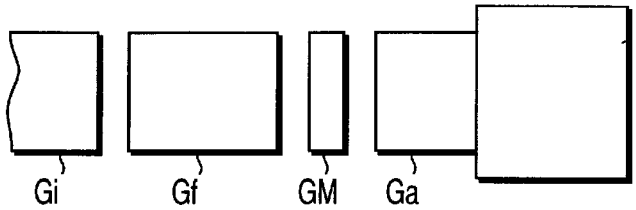
FIG. 6 is a view schematically showing a structure of a main lens as an example for illustrating the oval distortion of the beam spot.

As shown in FIG. 6, the main lens is constituted by a focus electrode Gf, an anode electrode Ga, and an intermediate electrode GM arranged between these electrodes. A quadrupole lens formed at a front stage of the main lens is constituted by an addition electrode Gi and the focus electrode Gf.

Figure 7:
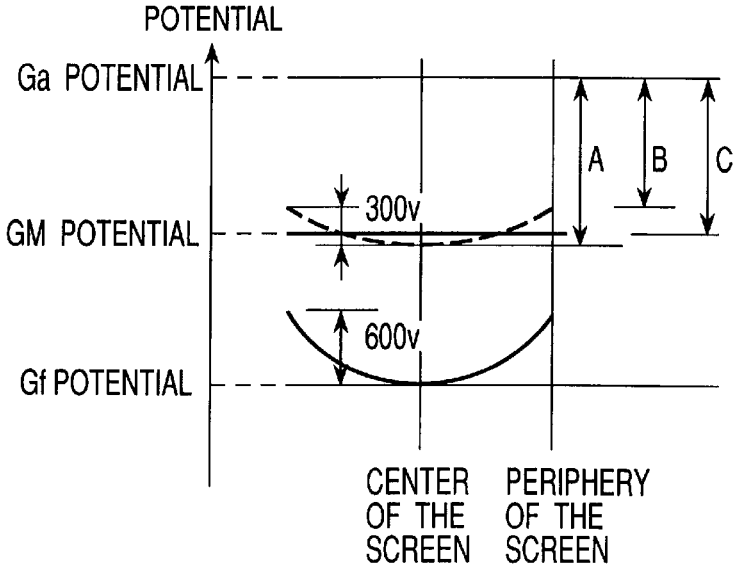
FIG. 7 is a view showing a potential of each electrode constituting the main lens for illustrating the oval distortion of the beam spot.

As shown in FIG. 7, a constant mid-level potential is applied to the intermediate electrode GM, and a constant high-level potential is applied to the anode electrode Ga. The dynamic focus voltage which parabolically changes in accordance with a quantity of deflection of the electron beams is applied to the focus electrode Gf.

As to the potential of the intermediate electrode GM in FIG. 7, a solid line indicates a potential when the dynamic focus voltage is not superposed on the intermediate electrode GM, and a broken line indicates a potential when the dynamic focus voltage is superposed on the intermediate electrode GM.

Figure 8A:
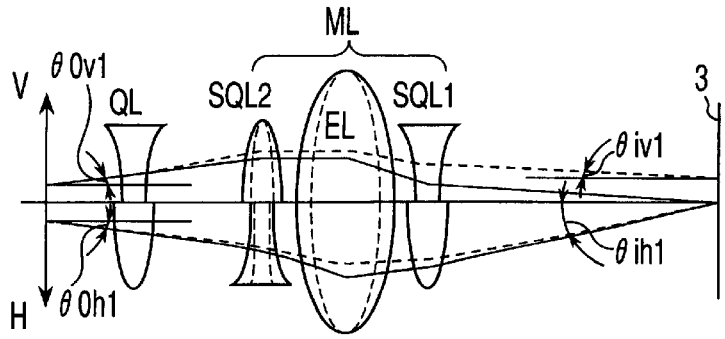
FIG. 8A shows an optical model for illustrating a lens action which acts on electron beams when a dynamic focus voltage is not superposed on an intermediate electrode in the main lens illustrated in FIG. 6.
Figure 8B:
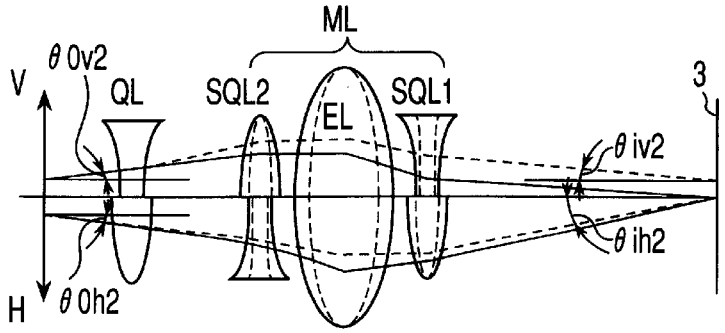
FIG. 8B shows an optical model for illustrating a lens action which acts on electron beams when the dynamic focus voltage is superposed on the intermediate electrode.

FIG. 8A shows an optical model of the electron lens in the horizontal direction and the vertical direction acting on the electron beams when the dynamic focus potential is not superposed on the intermediate electrode GM. FIG. 8B shows an optical model of the electron lens in the horizontal direction and vertical direction acting on the electron beams when the dynamic focus potential is superposed on the intermediate electrode GM.

Here, in FIGS. 8A and 8B, a solid line corresponds to the case of no deflection where the electron beams are focused onto the center of the phosphor screen, and a broken line corresponds to the case of deflection for deflecting the electron beams to the periphery part of the phosphor screen.

Assuming that an alternating component of the dynamic focus voltage is 600 V and a superposition ratio when the dynamic focus voltage is superposed on the intermediate electrode GM is 50%, a voltage of approximately 300 V is superposed on the intermediate electrode GM.

As shown in FIG. 7, when the dynamic focus voltage is not superposed on the intermediate electrode GM, a difference in potential between the intermediate electrode GM and the anode electrode Ga is C and constant in the both cases of deflection and no deflection.

On the contrary, when the dynamic focus voltage is superposed on the intermediate electrode GM, the potential of the intermediate electrode GM in the case of no deflection is lower than that in the case where the dynamic focus voltage is superposed, and a difference in potential between the intermediate electrode GM and the anode electrode Ga becomes A which is larger than C. Moreover, in case of deflection, the potential of the intermediate electrode GM is higher than that in the case where the dynamic focus voltage is not superposed, and a difference in potential between the intermediate electrode GM and the anode electrode Ga becomes B which is smaller than C. That is, when the dynamic focus voltage is superposed on the intermediate electrode GM, a difference in potential between the intermediate electrode GM and the anode electrode Ga is reduced from A to B as a quantity of deflection of the electron beams increases.

Consequently, as shown in FIG. 8B, when the dynamic focus voltage is superposed on the intermediate electrode GM, the lens action of the quadrupole lens SQL1 becomes weaker as compared with the case where the dynamic focus voltage is not superposed on the intermediate electrode GM shown in FIG. 8A as a quantity of deflection of the electron beams increases, the quadrupole lens SQL1 being arranged between the intermediate electrode GM and the anode electrode Ga and having the focusing action in the horizontal direction and the divergence action in the vertical direction.

In addition, as shown in FIG. 8B, when the dynamic focus voltage is superposed on the intermediate electrode GM, the lens action of the quadrupole lens SQL2 does not become weaker as compared with the case where the dynamic focus voltage is not superposed on the intermediate electrode GM shown in FIG. 8A as a quantity of deflection of the electron beams increases, the quadrupole lens SQL2 being arranged between the focus electrode Gf and the intermediate electrode GM and having the divergence action in the horizontal direction and the focusing action in the vertical direction relatively.

That is, as a result of superposition of the dynamic focus voltage on the intermediate electrode GM, the two quadrupole lenses SQL1 and SQL2 constituting the main lens ML have the divergence action which is strong in the horizontal direction and the focusing action which is strong in the vertical direction being relatively generated as a quantity of deflection of the electron beams increases as compared with the case where the dynamic focus voltage is not superposed on the intermediate electrode GM. Therefore, the focusing power is not sufficient in the horizontal direction with respect to the electron beams deflected in the periphery part of the phosphor screen and excessive focusing is observed in the vertical direction.

In order to correct such focusing, when the dynamic focus voltage is superposed on the intermediate electrode, the quadrupole lens QL formed between the addition electrode Gi and the focus electrode Gf is operated extra so that the focusing action in the horizontal direction and the divergence action in the vertical direction can be strengthened. As a result, the outermost trajectory of the electron beams in the horizontal direction is formed on the further inner side as compared with the case where the dynamic focus voltage is not superposed and the incidence angle upon the phosphor screen 3 becomes small, as shown in FIG. 8B. That is, $\theta ih2<\theta ih1$ is attained. Additionally, in the vertical direction, the outermost trajectory of the electron beams is formed on the further outer side as compared with the case where the dynamic focus voltage is not superposed and the incidence angle upon the phosphor screen 3 becomes large, as shown in FIG. 8B. That is, $\theta iv2>\theta iv1$ is achieved.

Consequently, when the dynamic focus voltage is superposed, the magnification in the horizontal direction becomes larger than that in the case where the dynamic focus voltage is not superposed, and Mh2>Mh1 is obtained. Further, the magnification in the vertical direction becomes smaller than that in the case where the dynamic focus voltage is not superposed, and Mv1>Mv2 is achieved. Therefore, the beam spot in the phosphor screen periphery part becomes long sideways.

That is, reduction in the superposition ratio of the dynamic focus voltage to the intermediate electrode enables alleviation of the lateral collapse of the beam spot in the phosphor screen periphery part.

Meanwhile, in (1), the pre-focus lens formed between the second grid G2 and the third grid G3 and the first non-axial-symmetrical lens QL1 formed between the third grid G3 and the fourth grid G4 are simultaneously operated. As a result, the comprehensive lens action in the horizontal direction of these lenses becomes the weak divergence action or the weak action which causes substantially no operation. Consequently, it is possible to suppress occurrence of the blur (halo) in the horizontal direction which is generated in the conventional electron gun structure combining the two non-axial-symmetrical lenses having different polarities.

That is, the prior art first non-axial-symmetrical lens has the divergence action in the horizontal direction and the focusing action in the vertical direction. The electron beam flux which has spread by the divergence action in the horizontal direction is greatly affected by the aberration component in the main lens. Therefore, the blur is generated in the horizontal direction by the operation of the first non-axial-symmetrical lens in the prior art.

On the contrary, in the electron gun structure having such a configuration as described in (1), the comprehensive lens including the first non-axial-symmetrical lens has the divergence action weak in the horizontal direction or a constant lens action such that substantially no operation is caused. Therefore, the influence of the aberration in the horizontal direction within the main lens is hardly given, and generation of the bur in the horizontal direction can be suppressed. Thus, the beam spot in the phosphor screen periphery part enlarges only in the vertical direction, and the oval distortion of the beam spot which is long sideways can be reduced.

Furthermore, in (2), the diameter of the beam spot in the horizontal direction can be decreased in the phosphor screen periphery part.

As described above, according to this embodiment, as to improvement of the oval distortion which is long sideways, different improvement directions are adopted depending on the horizontal direction and the vertical direction in the phosphor screen periphery part. In other words, in (1), the diameter of the beam spot in the vertical direction is enlarged mainly in the phosphor screen periphery part. Additionally, in (2), the diameter of the beam spot in the horizontal direction is reduced mainly in the phosphor screen periphery part. As a result, occurrence of the blur in the horizontal direction can be suppressed, and the lateral oval distortion can be improved in the phosphor screen periphery part, thereby obtaining the excellent focusing characteristic in the entire phosphor screen area.

The present invention is not restricted to the above-described embodiment.

For example, although two electrodes to which a voltage is supplied through the resistor are arranged in the main lens in the foregoing embodiment, a number of the electrodes may be one, or three or more.

Figure 3C:
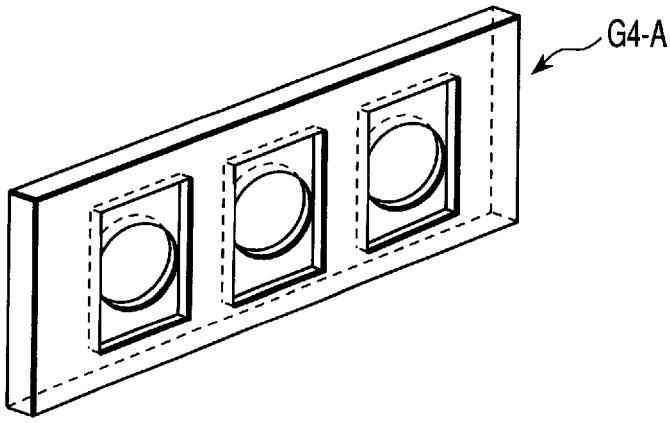
FIG. 3C is a perspective view schematically showing another shape of electron beam passage holes formed on the surface of the fourth grid which is opposed to the third grid in the electron gun structure depicted in FIG. 2.

Further, although the electron beams passage holes having a shape such as shown in FIG. 3B are provided on the surface of the fourth grid G4 opposed to the third grid G3 in the above embodiment, an electron beam passage holes having a shape such as shown in FIG. 3C may be provided.

Furthermore, in the above-described embodiment, among the grids constituting the main lens, a number of grids to which a voltage is supplied from the resistor is two and the voltage is supplied to the respective grids through the different voltage supply terminals. The present invention is not restricted to this example.

Figure 9:
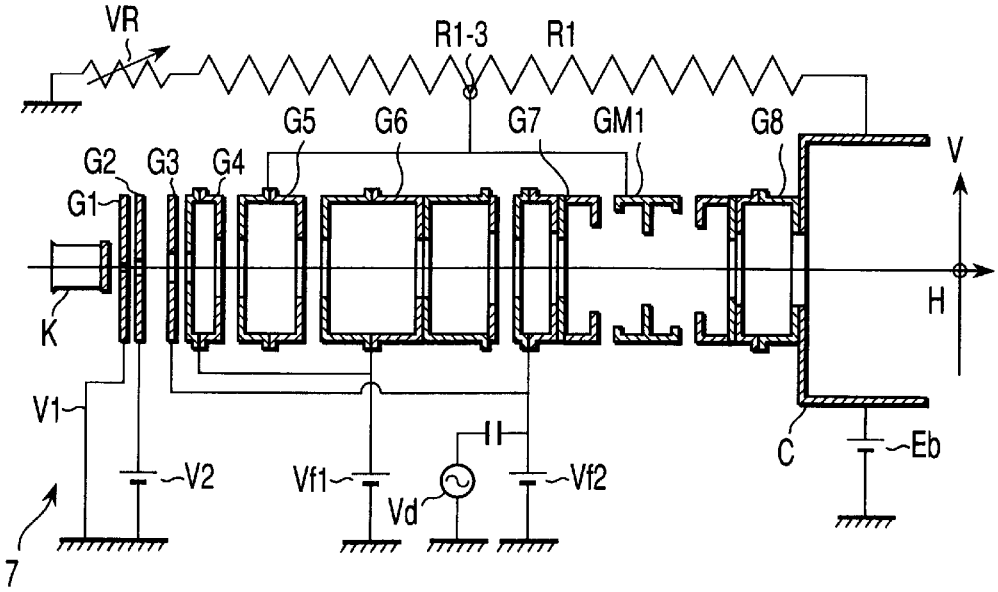
FIG. 9 is a vertical cross-sectional view schematically showing another embodiment of an electron gun structure applied to the cathode ray tube apparatus according to the present invention.

That is, as shown in FIG. 9, the main lens may be made up of a dynamic focus electrode G7 to which the dynamic focus voltage is supplied, an anode electrode G8 to which the anode voltage is supplied, and one first auxiliary electrode GM1 arranged between these electrodes. In such a structure, the first auxiliary electrode GM1 is connected to the fifth grid G5 in the tube, and a voltage is supplied to the first auxiliary electrode GM1 through a single voltage supply terminal R1-3 on the resistor R1.

In such an electron gun structure, each of the surface of the dynamic focus electrode G7 opposed to the first auxiliary electrode GM1, the surface of the first auxiliary electrode GM1 opposed to the dynamic focus electrode G7 and the anode electrode G8 and the surface of the anode electrode G8 opposed to the first auxiliary electrode GM1 is provided with an electron beam passage hole common to the three electron beams.

Consequently, as similar to the above-described embodiment, even if the dynamic focus voltage is applied to the dynamic focus electrode G7, it is possible to reduce the superposition ratio of the alternating component superposed on the first auxiliary electrode grid through the electrostatic capacity between the electrodes.

Accordingly, this can suppress the undesirable lens operation generated between the dynamic focus electrode G7 and the first auxiliary electrode GM1 and between the first auxiliary electrode grid GM1 and the anode electrode G8, thereby obtaining the excellent focusing characteristic on the entire phosphor screen area.

Moreover, since a number of electrodes can be decreased, increase in cost can be suppressed, and an error in the electron beams trajectory due to increase in number of electron lenses can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube apparatus comprising:

an electron gun structure having an electron beam formation portion for forming electron beams and a main lens portion for focusing said electron beams onto a phosphor screen; and a deflection yoke for generating a deflection magnetic field f or scanning in a horizontal direction and a vertical direction on said phosphor screen by deflecting said electron beams emitted from said electron gun structure, wherein said electron gun structure further includes a first non-axial-symmetrical lens portion whose lens action changes in accordance with a quantity of deflection of said electron beams and which is arranged in the vicinity of said electron beams formation portion, and a second non-axial-symmetrical lens portion whose lens action changes in accordance with a quantity of deflection of the electron beam and which is formed to said main lens portion;

said first non-axial-symmetrical lens portion has a lens action in the vertical direction that a focusing action relative to said electron beams becomes stronger as a quantity of deflection of said electron beams increases, and a lens act ion in the horizontal direction which substantially rarely acts on said electron beams as compared with said lens action in the vertical direction; and a comprehensive lens system of said second non-axial-symmetrical lens portion and said main lens portion has a lens action in the vertical direction that a divergence action with respect to said electron beams becomes stronger as a quantity of deflection of said electron beams increases, and a lens action in the horizontal direction which substantially rarely acts on said electron beams.

2. A cathode ray tube apparatus comprising:

an electron gun structure having an electron beams formation portion forming electron beams and a main lens portion for focusing said electron beams onto a phosphor screen; and a deflection yoke for generating a deflection magnetic field for scanning in a horizontal direction and a vertical direction on said phosphor screen by deflecting said electron beams emitted from said electron beam gun structure, wherein said electron gun structure includes:

an auxiliary electrode arranged between said electron beams formation portion and said main lens portion, a first dynamic focus electrode arranged between said electron beams formation portion and said auxiliary electrode, and a first focus electrode;

a second focus electrode which constitutes said main lens portion and is connected to said first focus electrode, a second dynamic focus electrode connected to said first dynamic focus electrode, at least one intermediate electrode, and an anode electrode; and voltage applying means which applies a first level voltage to said electron beam formation portion, applies a focus voltage on a second level which is higher than said first level to said first and second focus electrodes, applies to said first and second dynamic focus electrodes a dynamic focus voltage obtained by superposing a fluctuating voltage which fluctuates in synchronization with said deflection magnetic field on a reference voltage whose level is nearly equal to said second level, applies an anode voltage on a third level which is higher than said second level to said anode electrode, applies to said auxiliary electrode a voltage which is obtained by performing resistance division to said anode voltage through a resistor provided in the vicinity of said electron gun structure and whose level is higher than said second level and lower than said third level, and applies to said intermediate electrode a voltage which is obtained by performing resistance division to said anode voltage through said resistor and whose level is higher than said second level and lower than said third level, a non-axial-symmetrical lens being formed between said first dynamic focus electrode and said first focus electrode.

3. The cathode ray tube apparatus according to claim 2, wherein a comprehensive lens of an electron lens formed between said first dynamic focus electrode and an electrode which is adjacent to said first dynamic focus electrode and constitutes said electron beam formation portion, and said non-axial-symmetrical lens has a non-axial-symmetrical lens action whose focusing action in the vertical direction becomes stronger than that in the horizontal direction relatively as a quantity of deflection of said electron beams increases, and a lens action in the horizontal direction in said comprehensive lens system substantially rarely changes as a quantity of deflection in said electron beams increases as compared with a lens action in the vertical direction.

4. The cathode ray tube apparatus according to claim 2, wherein said first dynamic focus electrode is a plate-like electrode having a substantially circular electron beam passage hole, and said first focus electrode has an electron beam passage hole whose diameter in the horizontal direction is longer than that in the vertical direction on a surface thereof opposed to said first dynamic focus electrode.

5. The cathode ray tube apparatus according to claim 4, wherein the diameter of said electron beam passage hole formed to said first dynamic focus electrode is substantially equal to the diameter in the vertical direction of said electron beams passage hole formed to said first focus electrode.

6. The cathode ray tube apparatus according to claim 2, wherein said dynamic focus voltage varies in such a manner that it is lower than said focus voltage at the time of no deflection for focusing said electron beams onto a central part of said screen and a difference from said focus voltage is decreased as a quantity of deflection of said electron beams increases.

7. The cathode ray tube apparatus according to claim 2, wherein said auxiliary electrode is connected to said intermediate electrode.

8. The cathode ray tube apparatus according to claim 2, wherein said auxiliary electrode is arranged between said first focus electrode and said second focus electrode.

9. The cathode ray tube apparatus according to claim 2, wherein said intermediate electrode is arranged so as to be adjacent to said second dynamic focus electrode.

* * * * *